US006698167B2

(12) United States Patent
Busch

(10) Patent No.: US 6,698,167 B2
(45) Date of Patent: Mar. 2, 2004

(54) VARIABLE-FEED MULTIPLE BUNDLING APPARATUS

(75) Inventor: Burkhardt Busch, Hamburg (DE)

(73) Assignee: Gerhard Busch GmbH, Seevetal (DE)

( * ) Notice: Subject to any disclaimer, the term of this patent is extended or adjusted under 35 U.S.C. 154(b) by 7 days.

(21) Appl. No.: 09/829,131

(22) Filed: Apr. 9, 2001

(65) Prior Publication Data

US 2001/0027635 A1 Oct. 11, 2001

(30) Foreign Application Priority Data

Apr. 7, 2000 (DE) ..... 100 17 456

(51) Int. Cl.[7] ..... B65B 13/18; B65B 13/04
(52) U.S. Cl. ..... 53/589; 100/7
(58) Field of Search ..... 53/589, 582, 513; 100/6, 7

(56) References Cited

U.S. PATENT DOCUMENTS 2,630,750 A * 3/1953 Eberle ..... 100/27
2,684,626 A * 7/1954 Eberle ..... 100/14
3,114,308 A * 12/1963 Saxton et al ..... 100/4
3,901,138 A * 8/1975 Bilt ..... 100/14
4,228,733 A * 10/1980 Davis et al. ..... 100/26
4,473,005 A * 9/1984 Pasic ..... 100/26
4,566,378 A * 1/1986 Fleissner ..... 100/26

* cited by examiner

*Primary Examiner*—Rinaldi I. Rada
*Assistant Examiner*—Paul Durand
(74) *Attorney, Agent, or Firm*—Jenner & Block LLC

(57) ABSTRACT

An apparatus for multiply bundling stacks of cut reams which is comprised of multiple band stock wrapping devices, placed side by side, a move away device for individualizing the rows of cut stacks towards the band stock wrapping devices, and an upstream feeder pusher device. All devices are located on an alignment table for receiving a ream of cuts to be individualized and wrapped with band stock, with each ream of cuts consisting of multiple rows and stacks of cuts, where the depths and number of rows in each ream of cuts is variable.

13 Claims, 17 Drawing Sheets

VARIABLE-FEED MULTIPLE BUNDLING APPARATUS

BACKGROUND OF THE INVENTION

The present invention relates to apparatus for the multiple bundling or wrapping of stacks of cuts, said apparatus comprising a plurality of side-by-side band stock wrapping units, an upstream feed pusher unit, an alignment table for receiving a ream of cuts to be individualized and banded, said ream arranged in a plurality of rows of stacks of cuts, and a move-away unit for moving the rows of stacks of cuts from the fed-in ream and for individualizing same.

Multiple bundlers of this kind, which are known e.g. by DE 26 27 610 A1, are used to cut up large-size printed sheets into individual stacks of cuts—post cards, labels, pocket calenders and similar items—by means of a guillotine-type cutter and to wrap band stock around each individual stack for the further processing thereof.

Multiple bundlers of this kind may be fed by means of feed pusher units of the type known e.g. by DE 298 04 929 U1. In a feed pusher unit of this kind the individual rows of stacks of cuts constituting the ream to be individualized are pushed stackwise from the ream at 90° to the working direction and are then shifted another 90° for movement to a multiple bundling station.

Swiss Patent 652,675 discloses a multiple bundler using a transverse blade to divide the reams of stacks of cuts. Following such division, the equally sized rows of stacks of cuts so formed are multiply wrapped and then separated to form individual stacks of cuts.

Finally, DE 195 02 535 A1 teaches a so-called bar-type bundler which separates a plurality of packs of cuts and bundles them to form a bar. To this end, the device picks up cuts placed in a planar side-by-side relationship and assembles them to form a bar for bundling.

SUMMARY OF THE INVENTION

It is the object of the present invention to simplify the operation of a multiple bundler and to obtain enhanced versatility in the processing of the reams of cuts.

This object is achieved by providing for a variable depth of the rows of stacks constituting a ream of cuts. Also, provisions can be included for moving the rows of stacks of cuts away sequentially and for individually wrapping the stacks of cuts constituting said moved-away rows.

The ream of cuts consists of rows of stacks of cuts in their cut-to-size condition, each stack having the same stacking depth and the same or a variable width; a machine for processing such reams includes provisions to arrange the feed pusher unit, the move-away unit and the bundling station in an straight-line relationship in a working direction.

In prior multiple bundlers it was necessary to place the cut-to-size stacks of cuts on a feed table and to advance them by means of a pusher member having the same width. For individualizing them, a transverse pusher would move each stack 90° out of the path of movement to a bundling position from where another pusher would advance it on its desired path, this second pusher acting at another 90° angle so as to forward the rows of stacks of cuts to the bundling station proper.

In the present invention, the ream, which are made up of cut-to-size stacks of cuts in a broad variety of row depths and stack widths, can be loaded and processed in a straight-line working direction. Angled paths of movement are avoided, and the feed or alignment table of the multiple bundling machine can be loaded directly from the upstream guillotine cutter.

The move-away unit is capable of detecting and moving a broad variety of row depths and stack widths in a ream of cuts. The number of stacks within each row of stacks can be variable, as can be the number of rows of stacks of cuts within a ream of cuts.

The inventive multiple bundling machine (in-line bundler) does not require personnel of its own as the bundling operation is readily controlled by the personnel operating the preceding machine, which regularly is a guillotine cutter.

Further advantageous measures are described in the dependent claims. The invention is shown in the attached drawing and will be described in greater detail herein below.

DETAILED DESCRIPTION OF THE PREFERRED EMBODIMENTS

Figure 1:
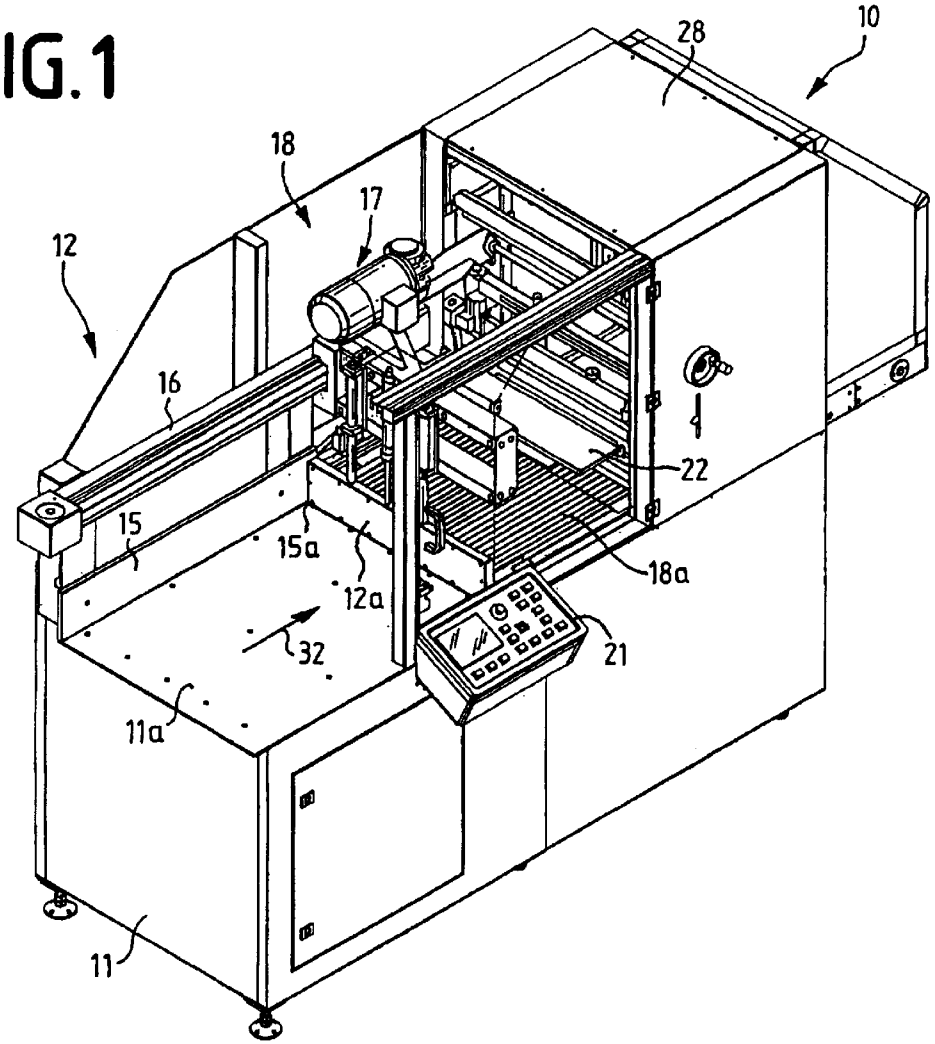
FIG. 1 is an isometric view of a multiple bundler incorporating an upstream straight-line feed pusher/move-away unit.

The assembly shown in FIGS. 1 to 4 constitutes a so-called multiple bundler 10 substantially comprising a feed pusher unit 12, a move-away unit 18 and a bundling station 28. Feed pusher unit 12, move-away unit 18 and bundling station 28 are arranged one behind the other in a straight-line relationship along a working direction 32 (arrow) and are incorporated in the multiple bundler.

Feed pusher unit 12 consists of a feed or alignment table 11 having a continuous smooth platen 11*a* along which a feed pusher 12*a* of unit 12 is reciprocable.

A drive and lift unit 17 is provided to reciprocate feed pusher 12*a* up and down, as well as back and forth, relative to platen 11*a*. To this end, feed pusher 12*a* is guided along a feed pusher guide rail 16 mounted above platen 11*a*. Further, alignment table 11 has a substantially vertically upright alignment plate 15 cooperating with platen 11*a* and feed pusher 12*a* to form a cubical or rectangular corner 15*a*.

A control panel 21 is provided for jointly operating multiple bundler 10, feed pusher unit 12, move-away unit 18 and bundling station 28.

As shown in FIGS. 5 to 11, feed pusher unit 12 is joined in the working direction 32 by a move-away unit 18. Feed pusher unit 12 and move-away unit 18 have a common working plane 33. Move-away unit 18 essentially consists of a platen 18*a* having longitudinal slots 20 there through.

Individualizing means 19 are disposed inside longitudinal slots 20 for reciprocation along the working direction 32. In the embodiment example illustrated—see FIG. 13—said individualizing means 19 comprise blades sloped along their top surface.

These individualizing means 19 in the form of blades have a coefficient of friction higher than that of the remainder of slotted platen 18*a*. This way, the rows of stacks 14 to 14*n* placed on slotted platen 18*a* for individualizing can be drawn along working direction 32 into their end position 27 shown in FIG. 7.

To this end, individualizing means 19 are adapted to be moved back and forth in slots 20 in the working direction 32 along the entire slotted platen 18*a* so as to move rows of stacks 14 to 14*n* to be individualized into their end position 27.

Figure 5:
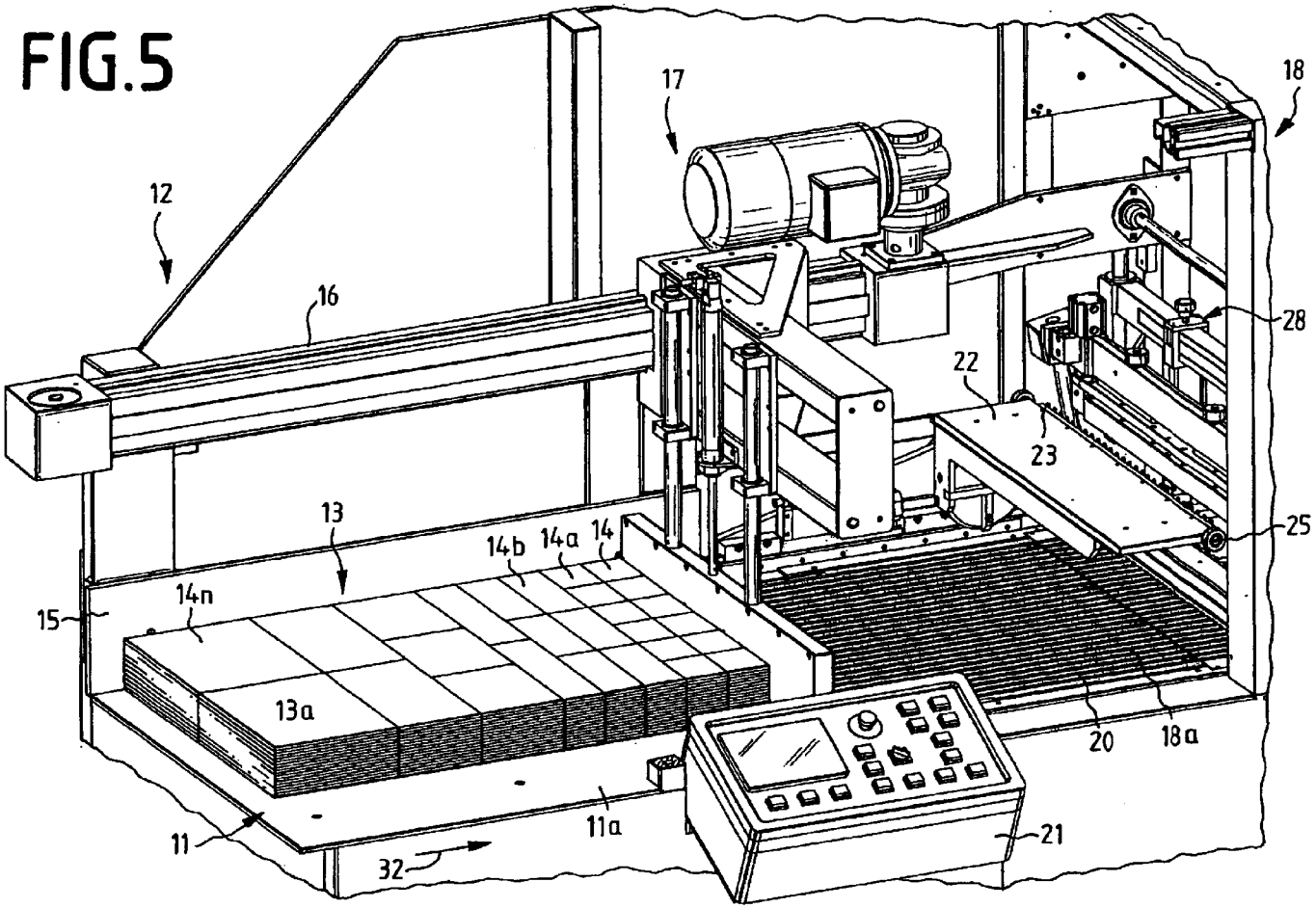
FIG. 5 is an isometric view of a feed pusher/move-away unit of FIG. 1, showing a primary pusher in the load position, the move-away unit in its basic position and the secondary pusher in the wait position.

As further shown in FIG. 5, a ream 13 loaded on alignment table 11 may comprise a plurality of rows of stacks 14*a*, 14*b*, 14*c* to 14*n*.

Figure 2:
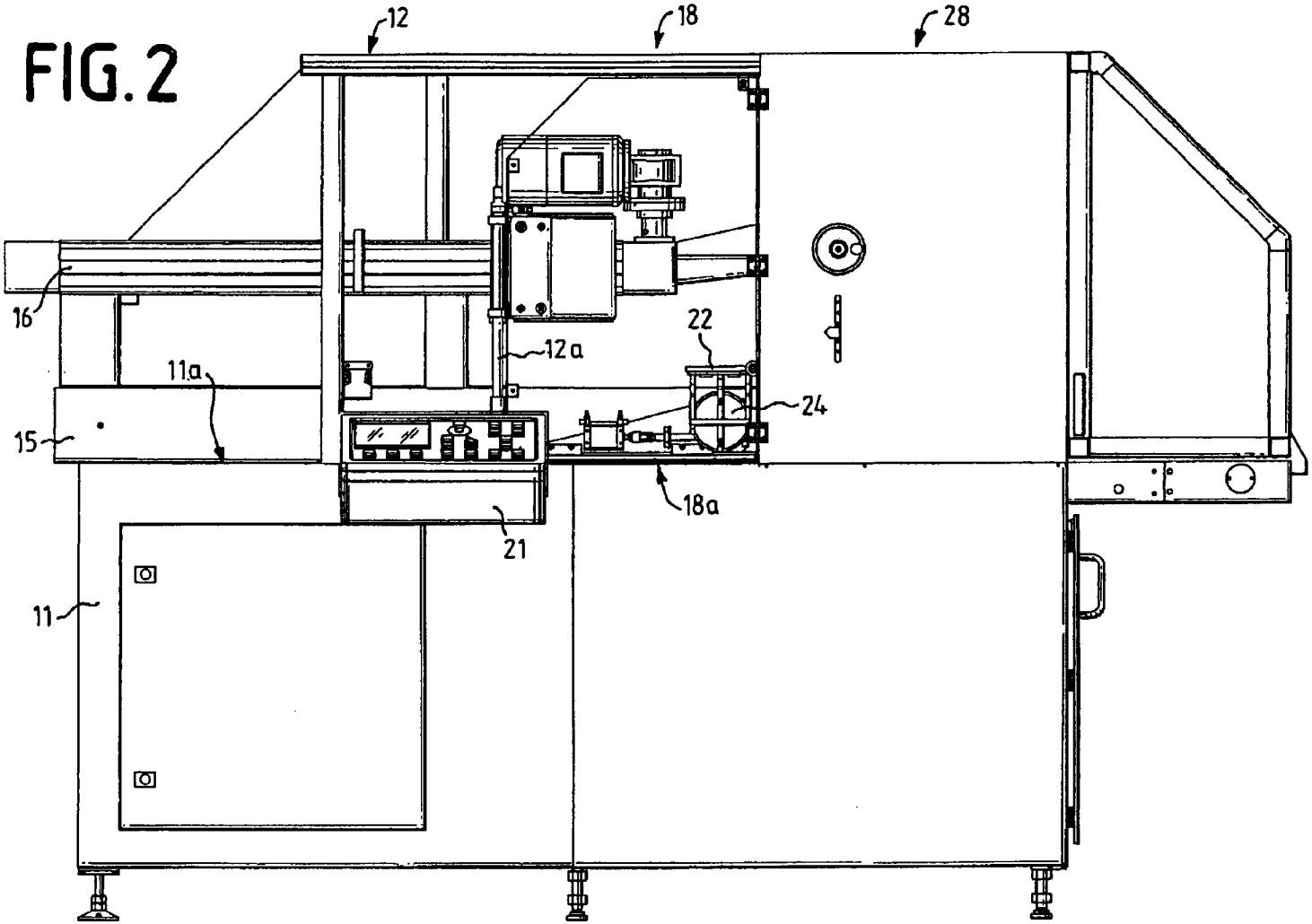
FIG. 2 is a side view of a multiple bundler of FIG. 1.
Figure 3:
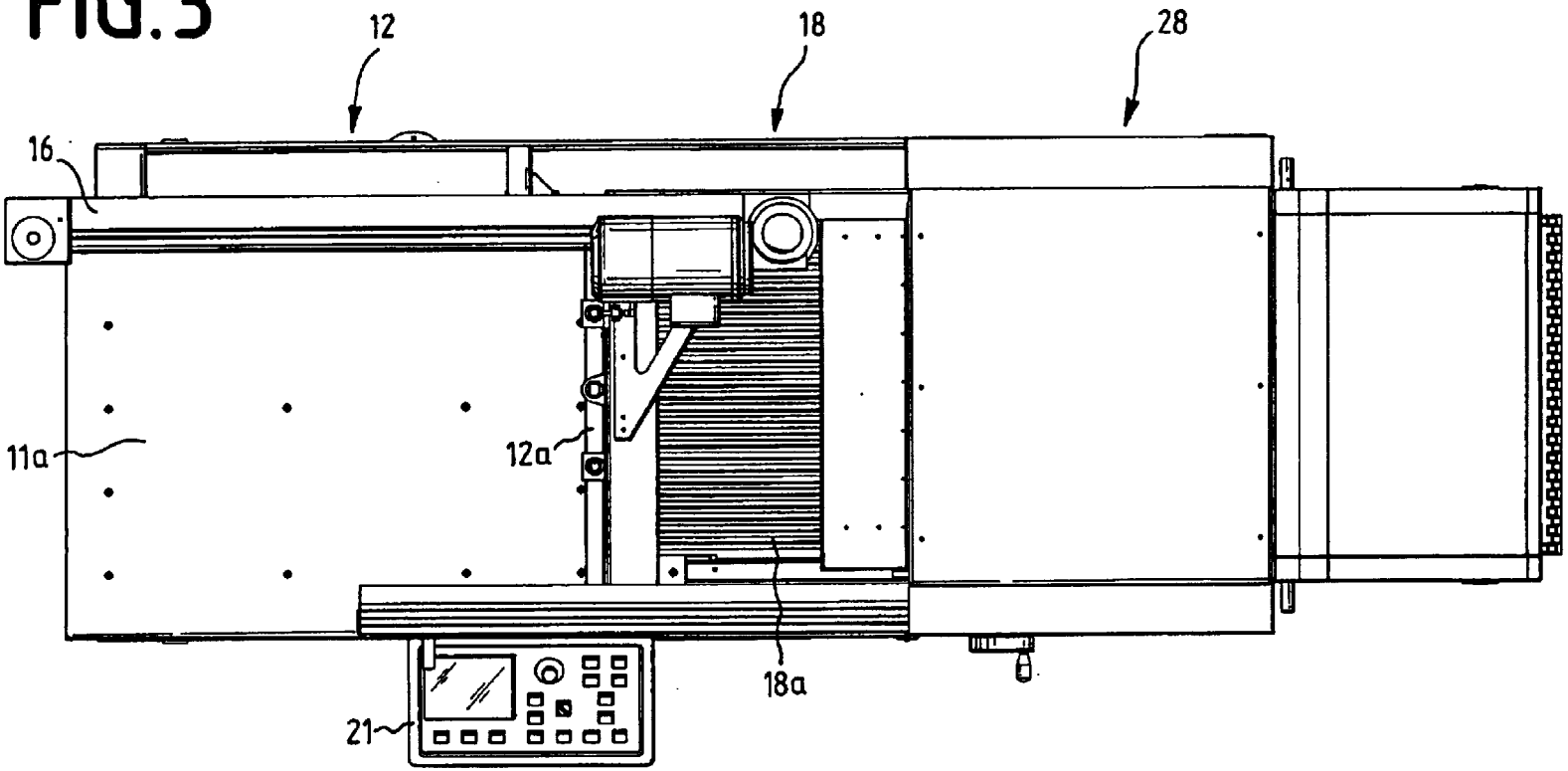
FIG. 3 is a plan view of a multiple bundler of FIG. 1.
Figure 4:
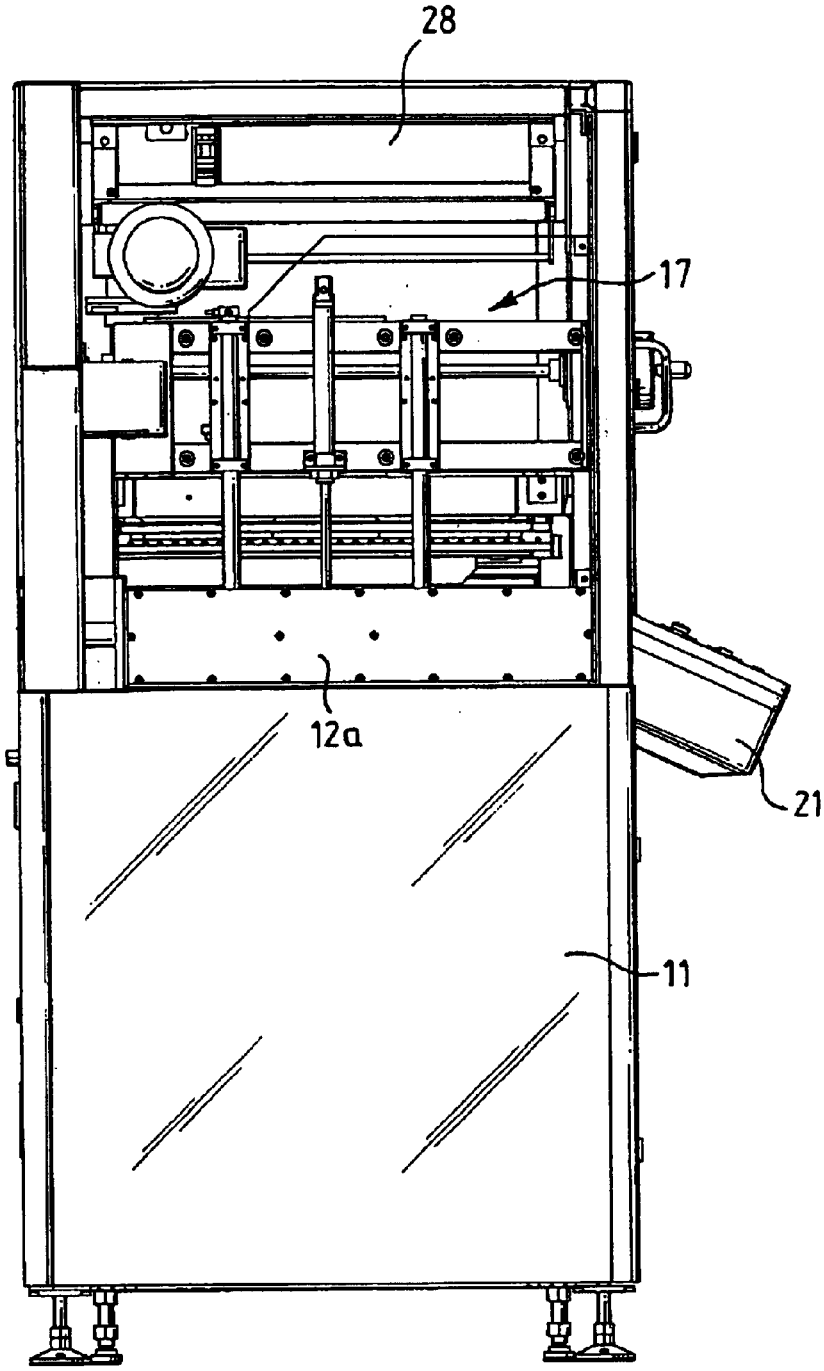
FIG. 4 is a front view in the direction of product movement of the multiple bundler of FIG. 1.
Figure 6:
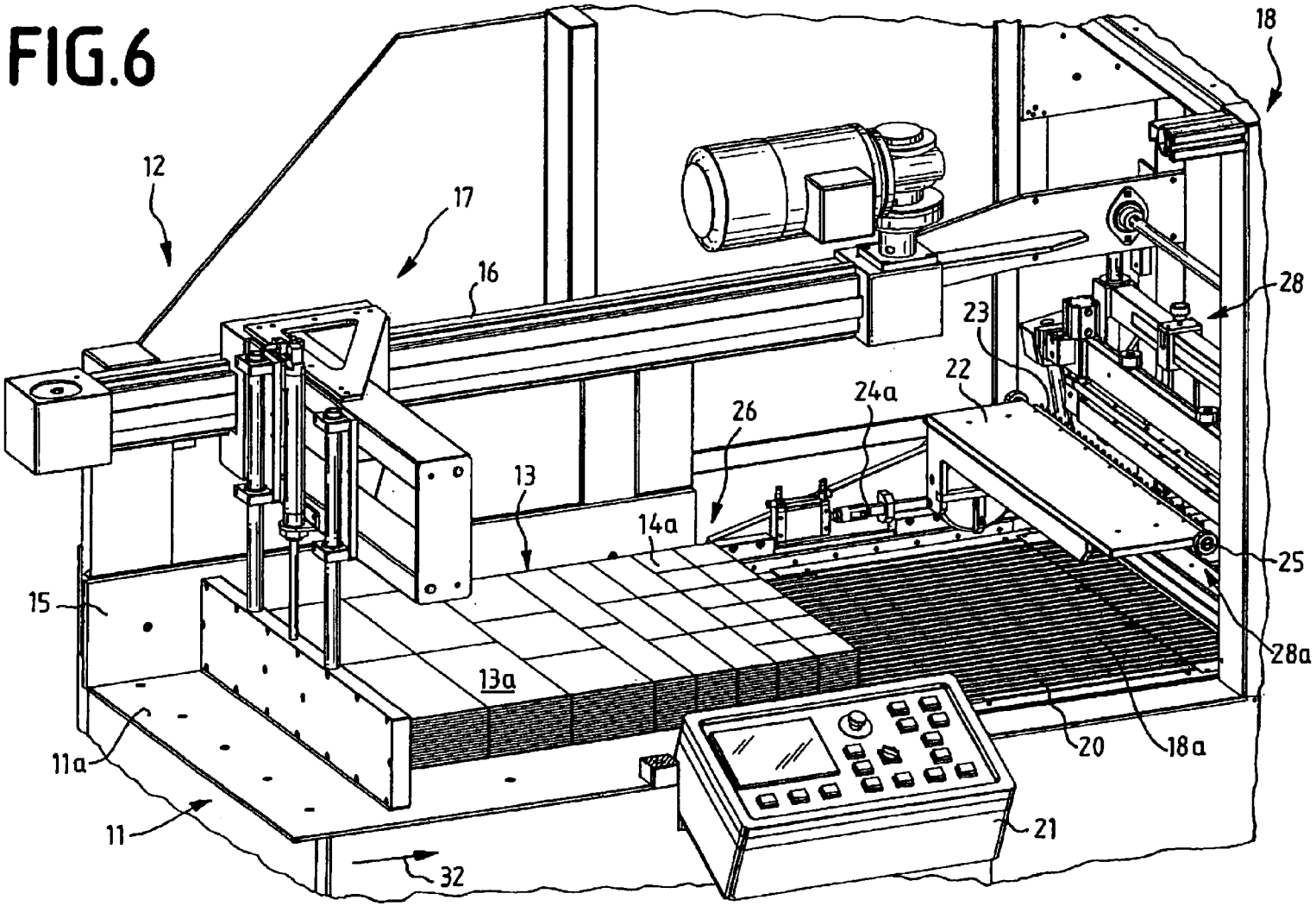
FIG. 6 shows the feed pusher/move-away unit of FIG. 5 with the primary feed pusher raised, moved back and lowered behind the last row of stacks of cuts and the ream of cuts to be divided advanced to the position of scanner-controlled transfer to the move-away unit.
Figure 7:
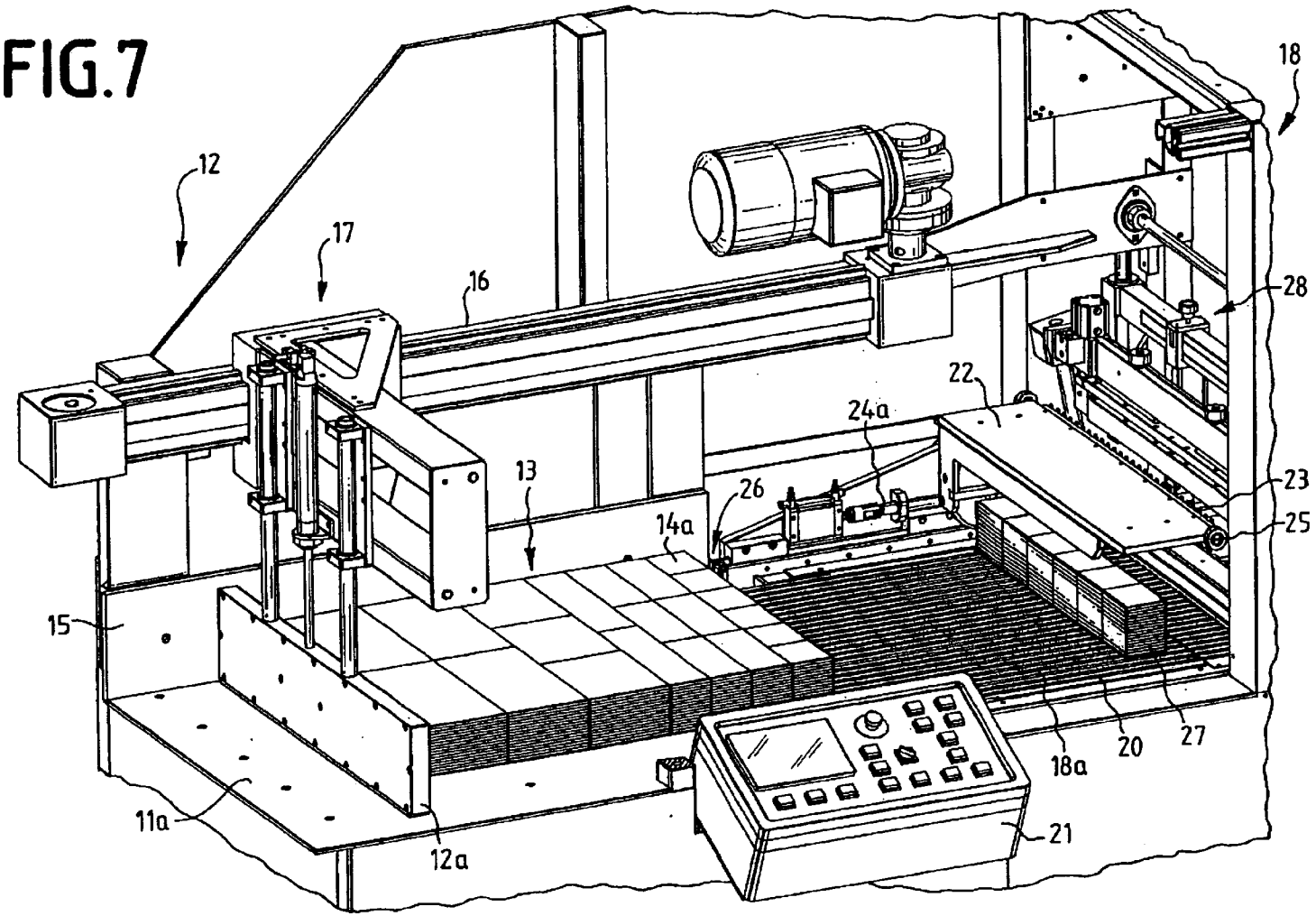
FIG. 7 shows the feed pusher/move-away unit of FIGS. 5 and 6, with a primary row of stacks of cuts moved to its end position by the move-away unit.

As shown in FIG. 2, slotted platen 18*a* has associated therewith a secondary pusher 22 adapted to be rotated by pusher pivoting mechanism 24 by about 90° above the top level of rows of stacks 14 to 14*n*, said secondary pusher also adapted to be reciprocated along working direction 32 by means of a pushing unit 24*a*, which FIG. 6 shows in greater detail.

On its bottom side facing slotted platen 18*a*, said secondary pusher 22 has tabs 23 thereon which engage longitudinal slots 20. These pushing tabs 23 engaging longitudinal slots 20 reach underneath the advanced rows of stacks 14 and keep the lowermost sheets thereof from sticking to platen 18*a*.

Figure 12:
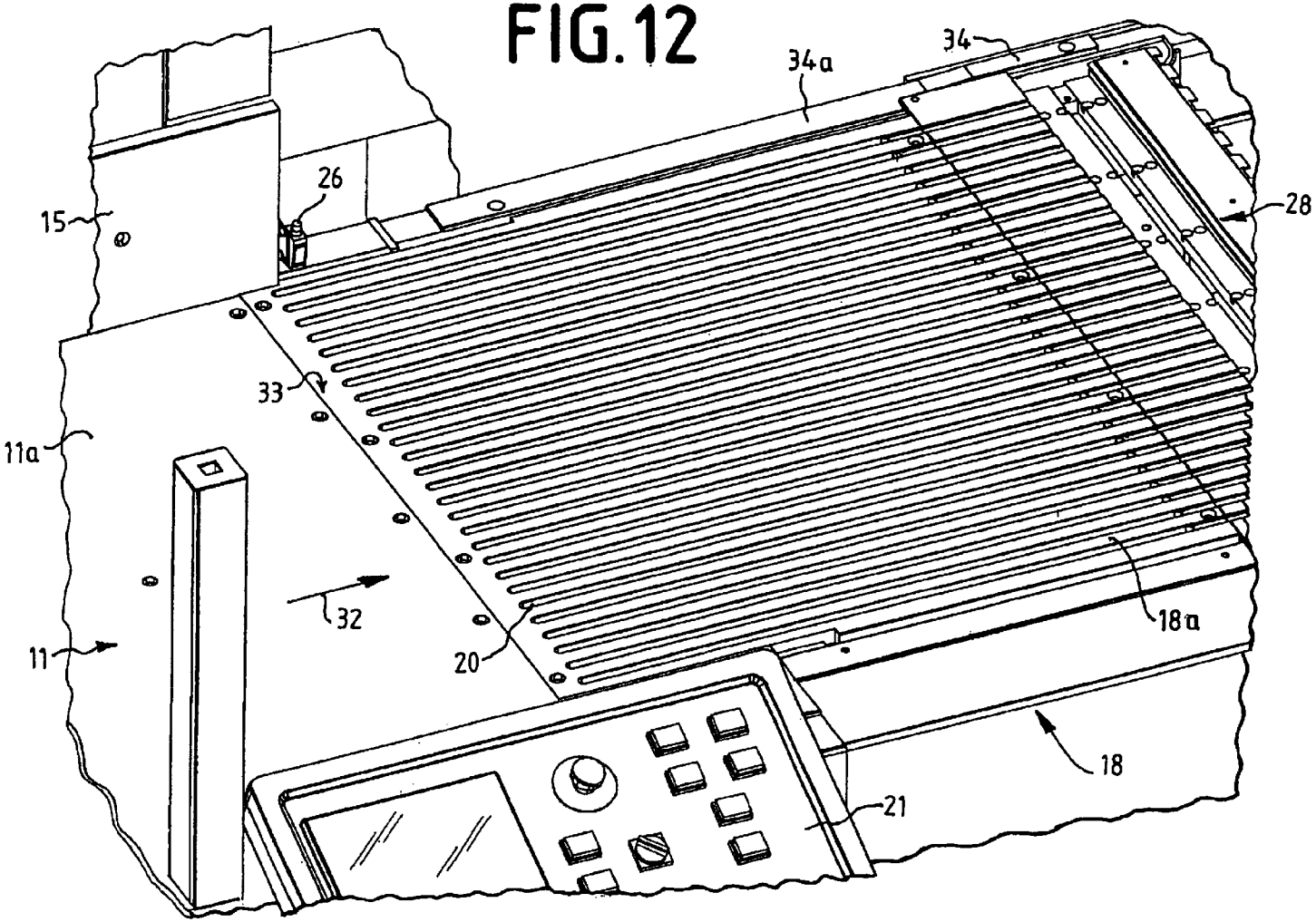
FIG. 12 shows an isometric detail of a slotted platen of a move-away unit with the individualizing means sunk into the platen.
Figure 13:
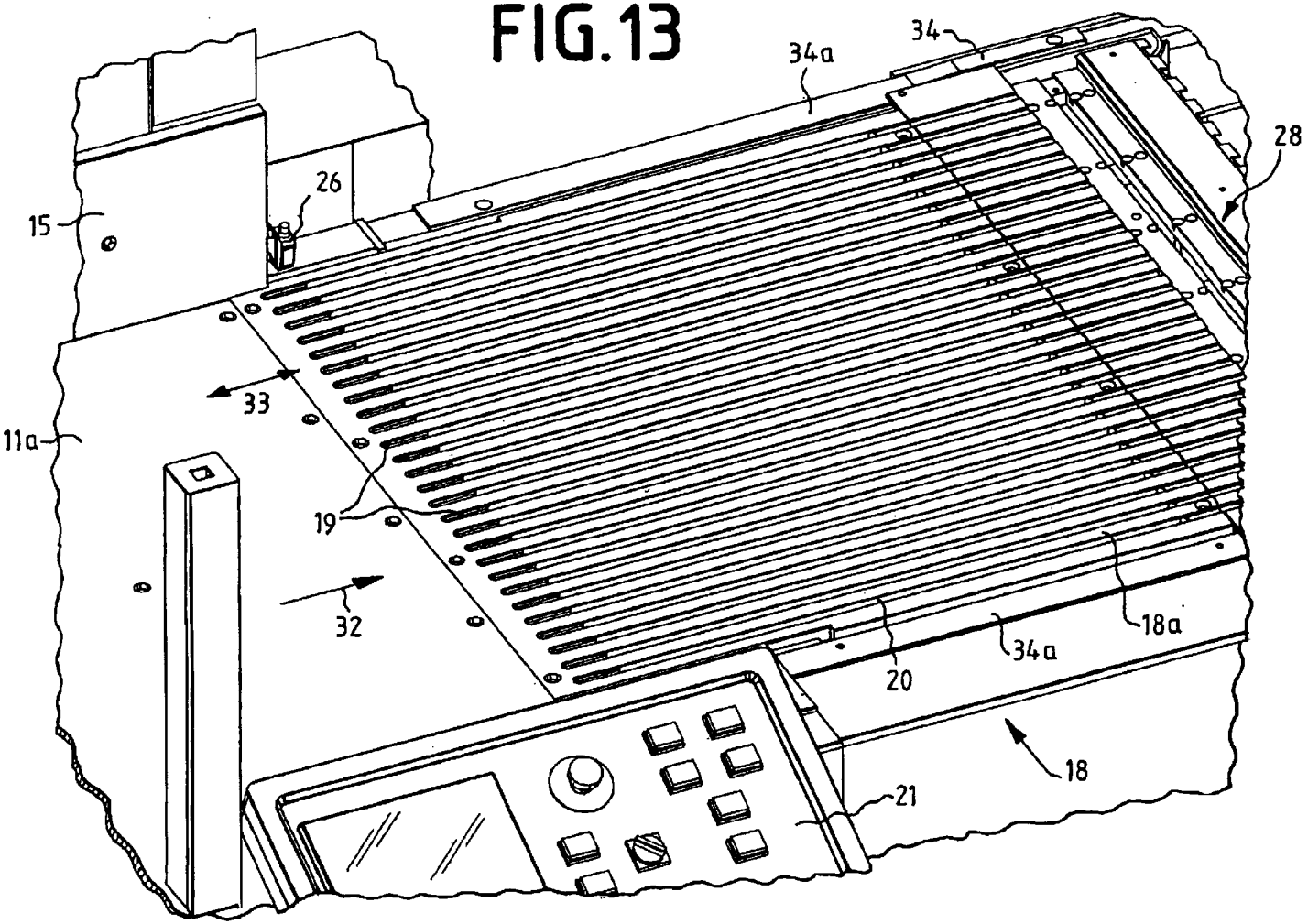
FIG. 13 shows an isometric view of a slotted platen as in FIG. 12 with individualizing means raised from the longitudinal slots of the slotted platen above the working plane thereof at the transition from the feed pusher unit to move-away unit.

Secondary pusher 22 has guide rollers 25 on either side thereof. These guide rollers 25 run on guide rails 34*a* arranged along both sides of slotted platen 18*a*, as shown in FIGS. 12 and 13.

Figure 13A:
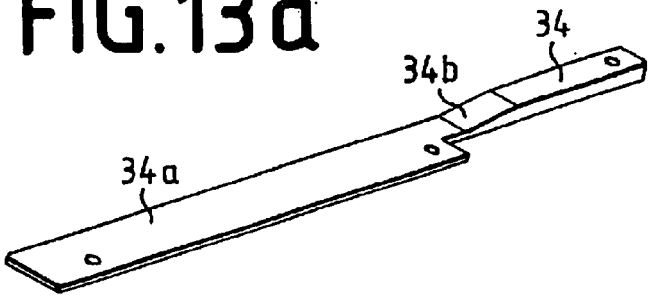
FIG. 13*a* shows a detailed isometric view of a lateral guide rail as in FIG. 13 with a ramp and a raised supporting surface.
Figure 17:
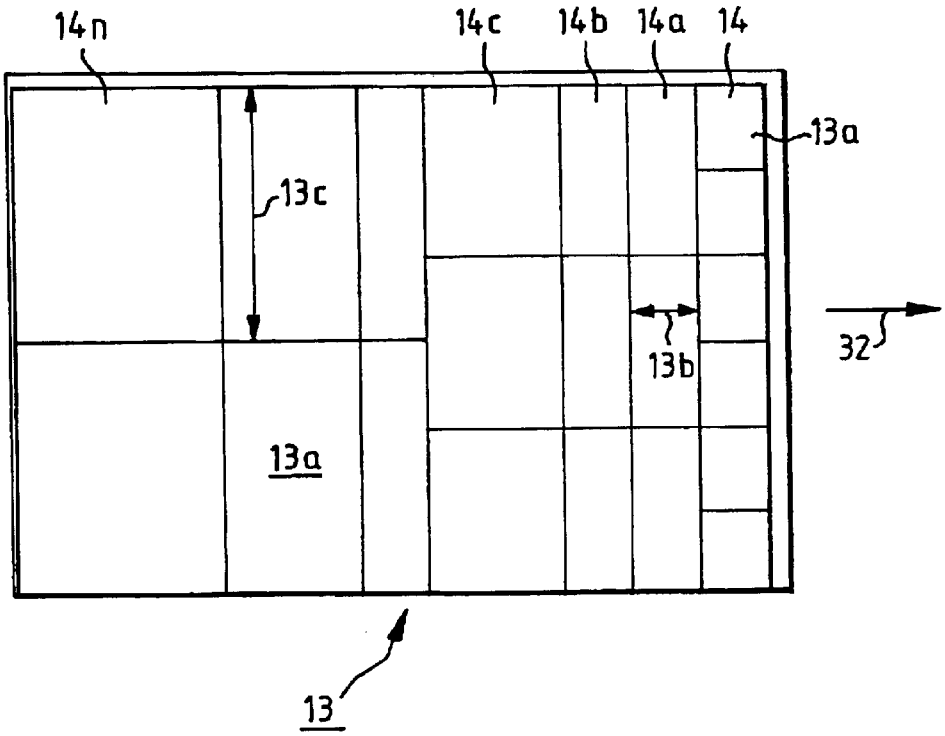
FIG. 17 shows a plan view of a ream of stacks of cuts to be separated and wrapped with band stock, with the stacks in each row and the rows of stacks in the ream each being variable in number.
Figure 14:
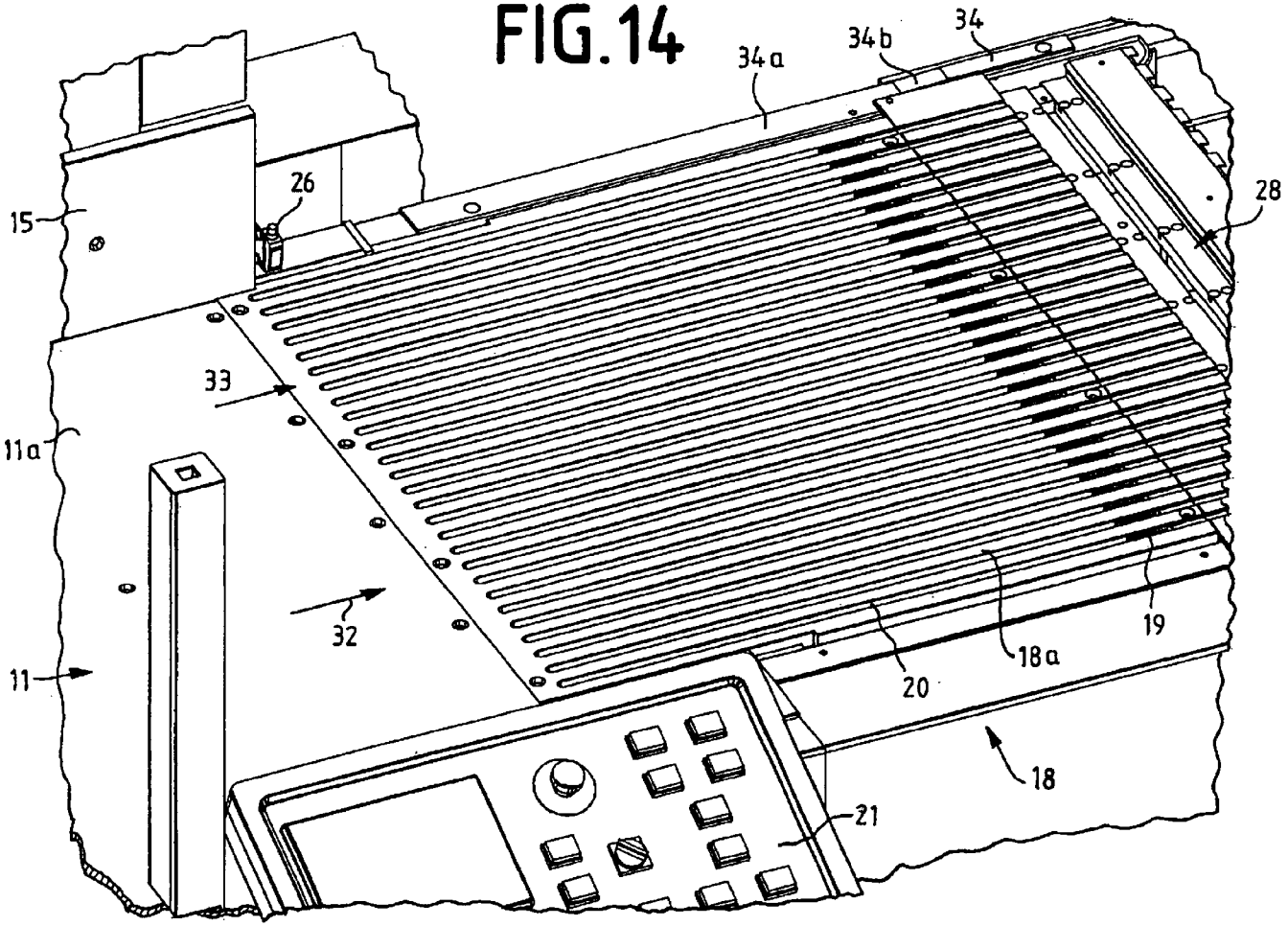
FIG. 14 shows an isometric view of a slotted plated as in FIGS. 12 and 13 with the individualizing means guided in the longitudinal slots and advanced to the end position.

Guide rails 34*a* enable said secondary pusher 22 to be moved across slotted platen 18*a*. In the process, it will be advanced up to the area of bundling station 28. As shown in FIG. 13*a*, lateral guide rails 34*a* have a ramp 34*b* which merges with a raised supporting surface 34 in the area of bundling station 28.

Ramp 34*b* of supporting surfaces 34 causes said secondary pusher 22 to be raised slightly—i.e. by about two to three millimeters—above working plane 33 of move-away unit 18 so as to prevent potential damage to the—usually padded—feed-in area 28*a* of bundling station 28.

One or more scanning devices 26 are provided between feed pusher unit 12 and move-away unit 18 to detect the position of the leading row of stacks 14 to be advanced once it has been positioned over the individualizing elements 14. Such scanning means may be in the form of sensors, light transmitter/detector combinations (light barriers) or the like. The position of scanning means 26 may be varied in dependence on the size and length of the rows of stacks 14 to 14*n* to be individualized so as to enable both very small cuts and very big cuts to be pushed safely into the bundling position.

Figure 8:
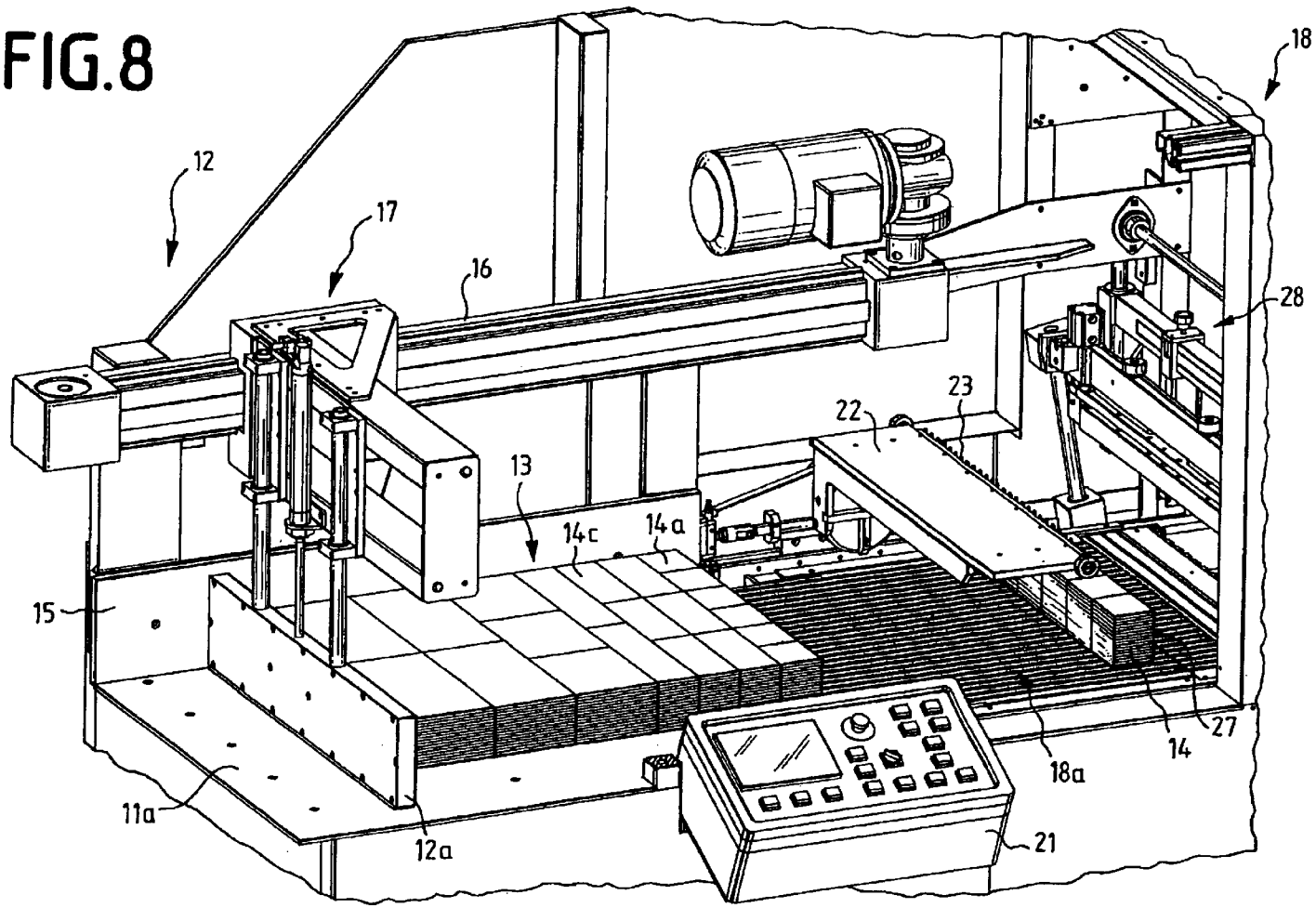
FIG. 8 shows the feed pusher/move-away unit of FIGS. 5 to 7 with the secondary pusher returned and pivoted up behind the separated row of stacks of cuts.
Figure 9:
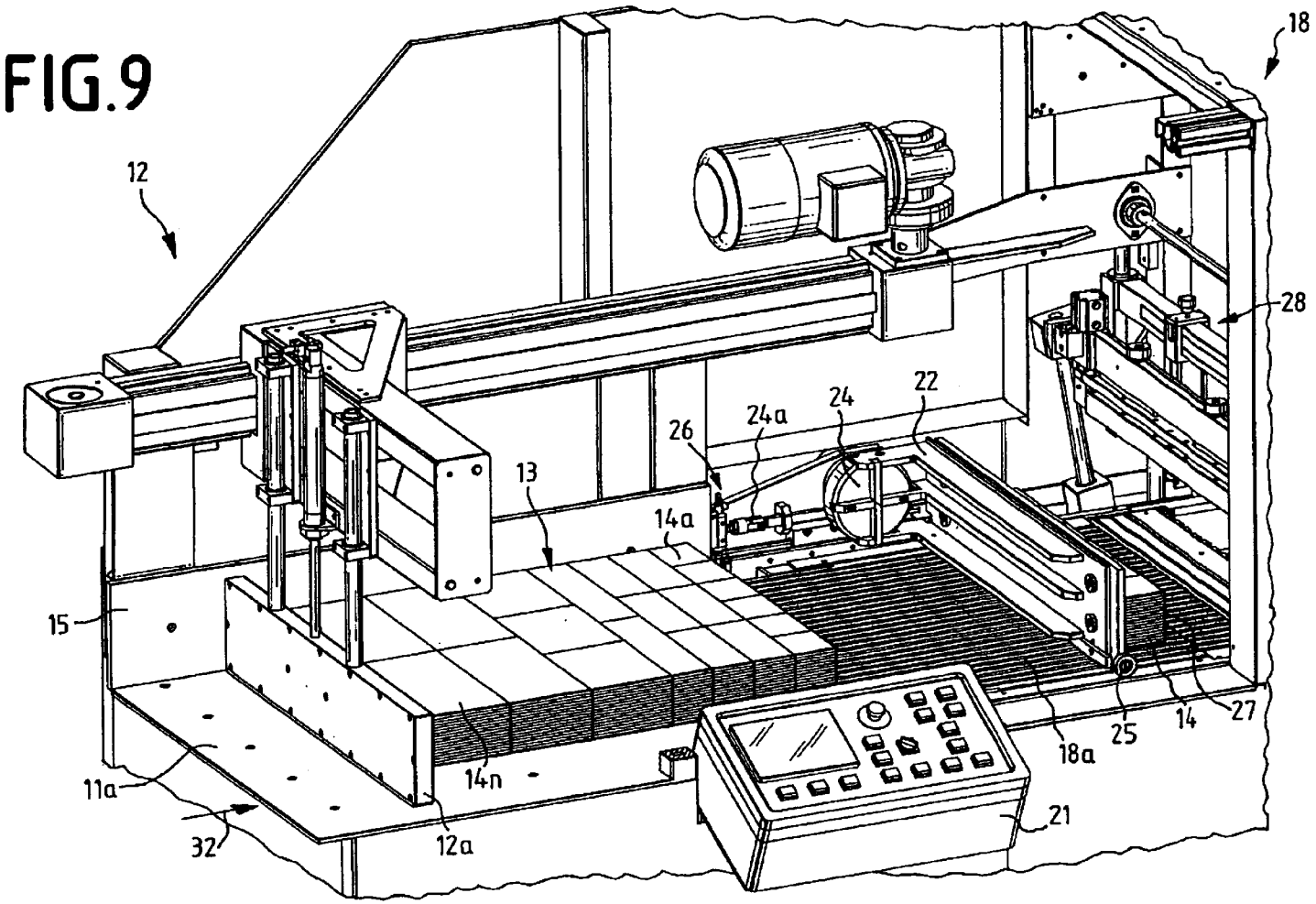
FIG. 9 shows a feed pusher/move-away unit of FIG. 8 with the secondary pusher lowered behind the separated row of stacks of cuts.

As shown in FIG. 8, the secondary pusher 22 is adapted to be moved by means of unit 24*a* in a direction opposite to working direction 32 behind row of stacks 14 placed down in its end position 27 by individualizing means 19. Having reached its position behind row of stacks 14, pusher 22 is rotated by pusher pivoting mechanism 24 to its push position shown in FIG. 9.

Figure 10:
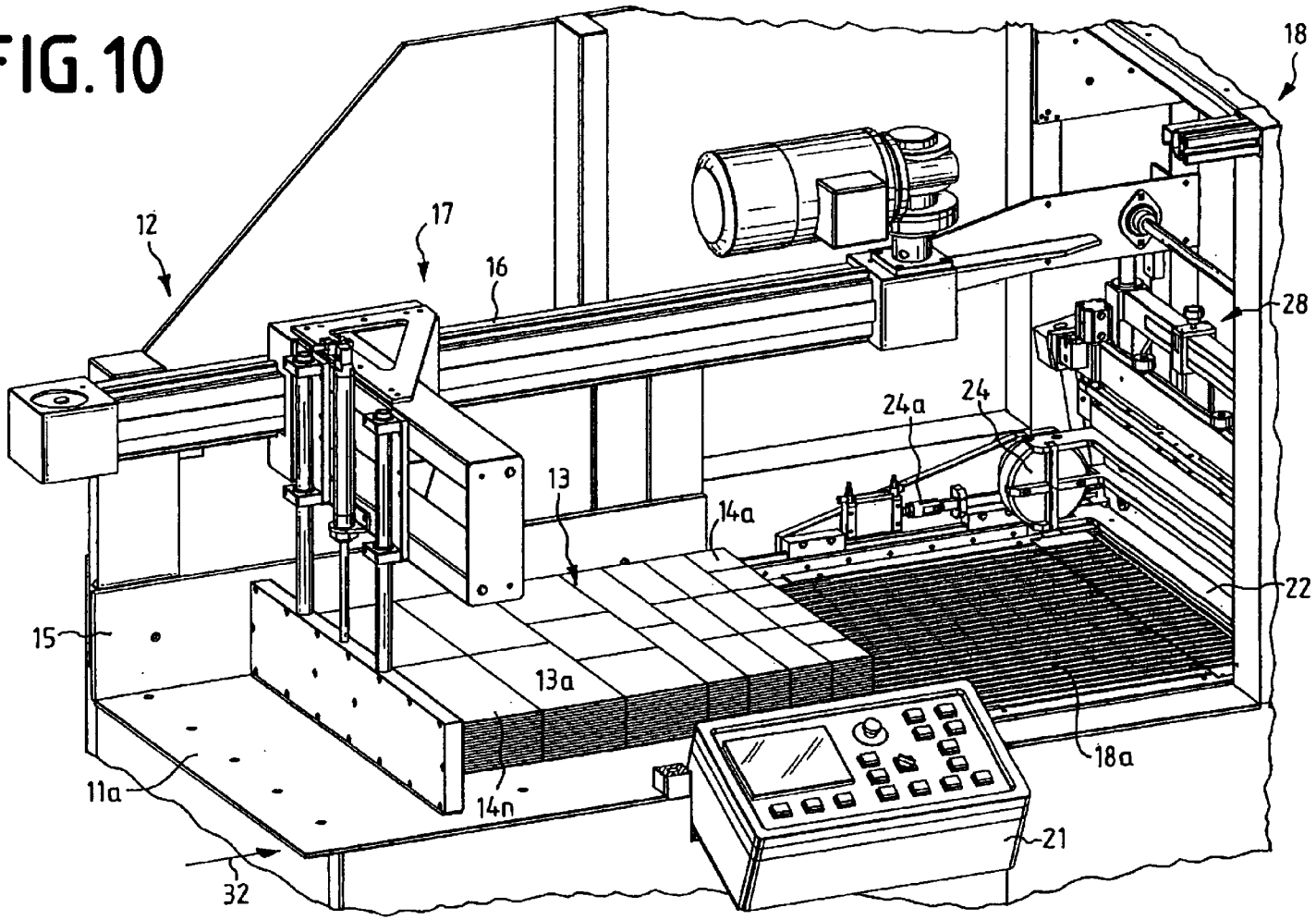
FIG. 10 shows a feed pusher/move-away unit of FIGS. 5 to 9 with a secondary pusher having pushed the row of stacks of cuts into the bundling position of the multiple bundler for wrapping with band stock.
Figure 11:
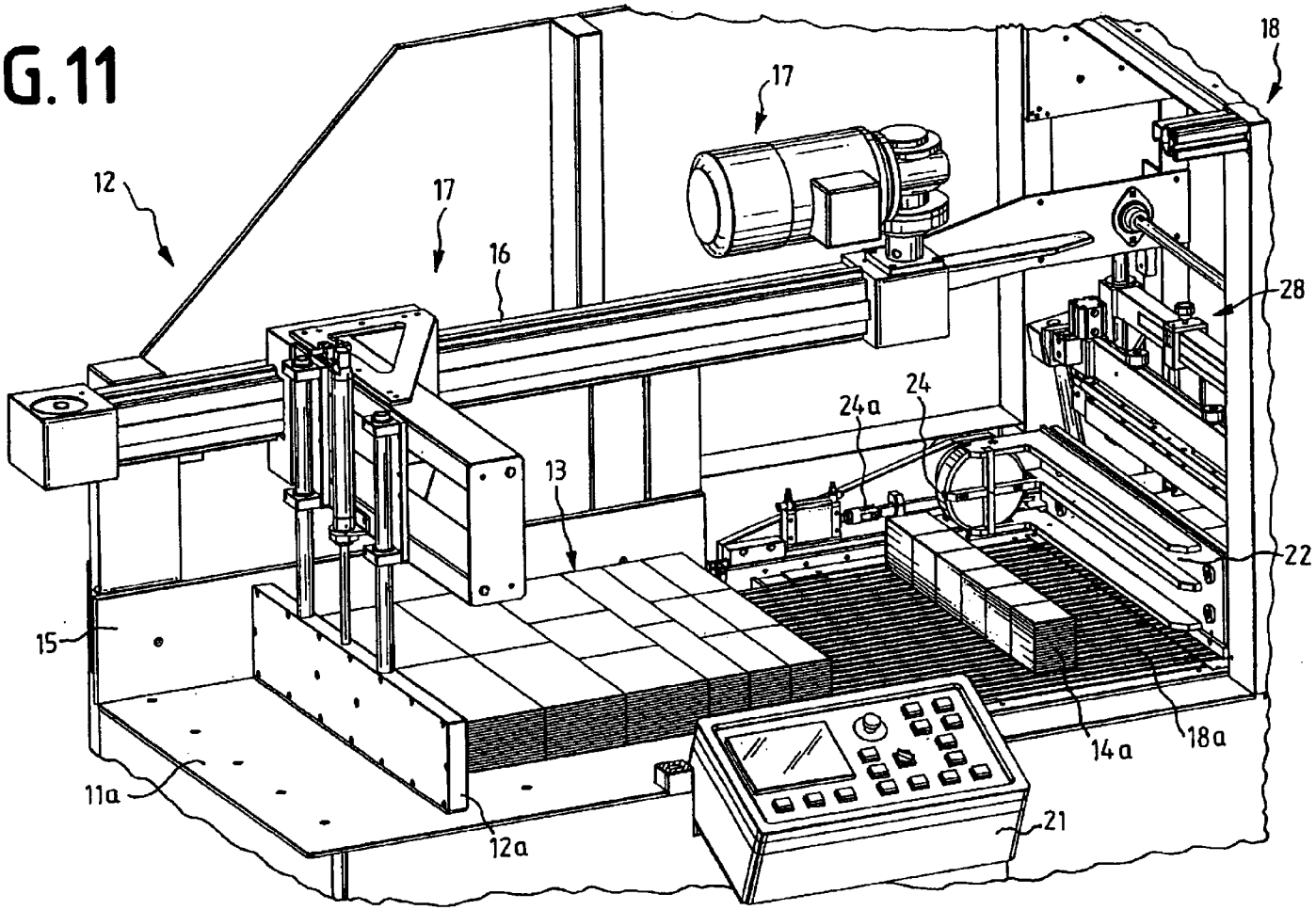
FIG. 11 shows a feed pusher/move-away unit of FIGS. 5 to 10 with the secondary pusher associated with the move-away unit in its forward waiting position and with the next row of stacks of cuts moved on the move-away unit and individualized by the primary pusher.

As shown in FIG. 10, row of stacks 14 to be wrapped with band stock is pushed by secondary pusher 22 into bundling station 28 for further processing. Immediately thereafter, or simultaneously therewith, the next row of stacks 14*a* to be processed is advanced by primary feed pusher 12*a* onto move-away unit 18 and then moved into end position 27 by individualizing means 19.

As shown in detail in FIG. 12, slotted platen 18*a* of move-away unit 18 has a plurality of longitudinally extending parallel slots 20 there through. In the transition area from feed pusher unit 12 to move-away unit 18, as shown in FIG. 13, individualizing means 19 are adapted to be raised from slots 20 above the level of working plane 33 of slotted platen 18*a*.

The scanning means 26 provided in the transition area from feed pusher unit 12 to move-away unit 18 are adapted to be adjusted to the length of the row of stacks to be individualized so as to raise individualizing means 19 under the leading stack 13*a* of a row of stacks 14 to be individualized.

Figure 15:
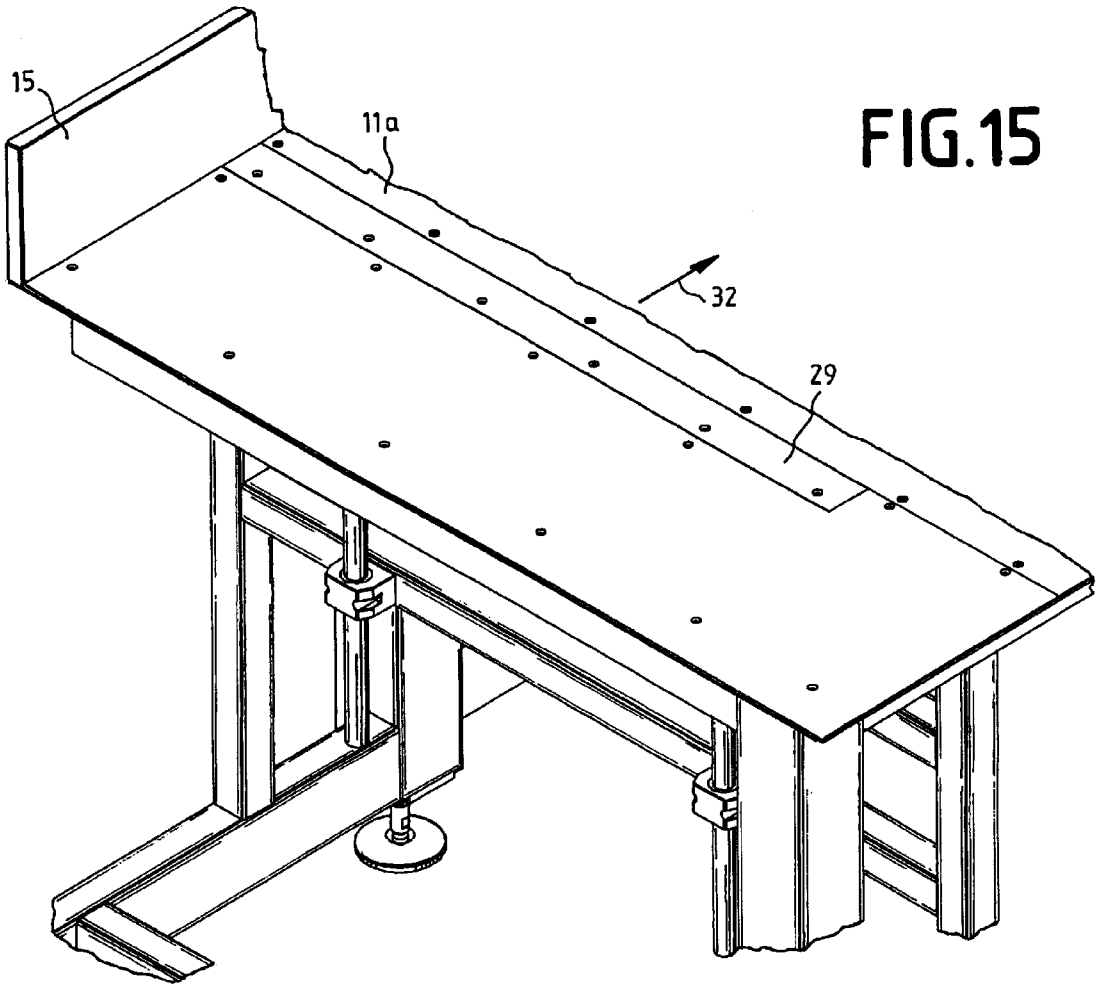
FIG. 15 shows an isometric view of an alignment table of a feed pusher unit for a multiple bundler as in FIG. 1 with the lift plate lowered.
Figure 16:
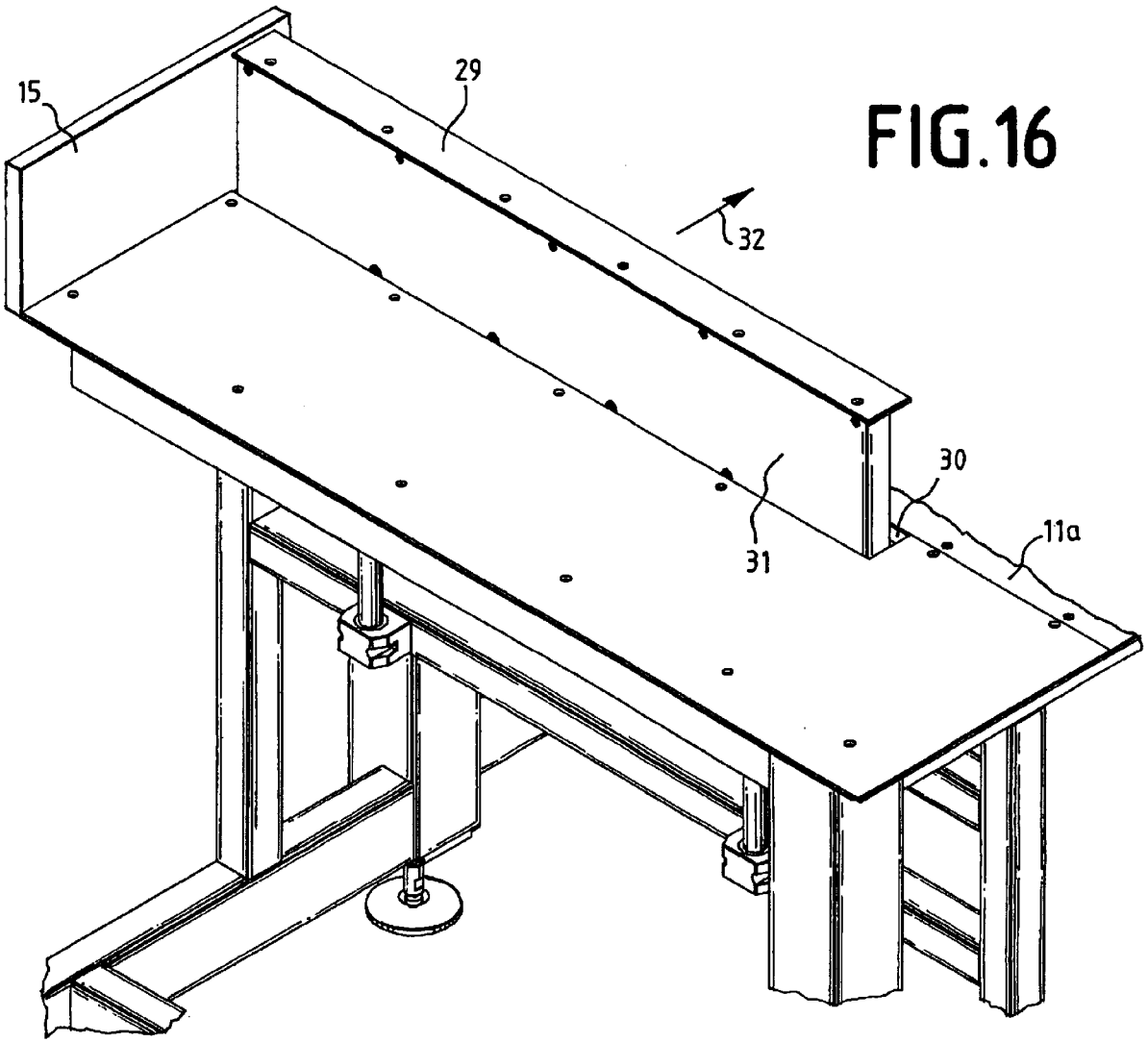
FIG. 16 shows an isometric view of a feeder table as in FIG. 15 with the lift plate raised.

As shown in FIGS. 15 and 16, a transversely extending slot 30 can be provided in platen 11*a* of aligning table 11 of feed pusher unit 12. This slot 30 receives a panel 29 adapted to be raised therefrom to form a stop 31 for a next-following ream of cuts 13 (not shown) to be processed; see FIG. 16. This stop 31 can be used to receive and align the next ream of cuts 13 for processing further down along the production line.

Another ream of cuts 13 to be processed can be aligned and positioned against stop 31 without delay by the feed pusher unit 12 during the return movement thereof so that the production run can start right after the unit has reached its return position. All these measures enable the feed, move-away and wrap operations to be performed in a quasi-continuous manner on complete rows of stacks 14 to 14*n* in one straight-line working direction 32.

Each ream of cuts 13 can comprise different numbers of stacks of cuts 13*a* in each row of stacks 14*a* to 14*n*. This way, a ream of cuts 13 can be assembled from rows of stacks 14*a* to 14*n* with stacks of cuts 13*a* having different widths.

The number of rows of stacks 14*a* to 14*n* within a ream 13 can vary if the row depths 13*b* of the individual rows of stacks 14*a* to 14*n* are different, so that any one row of stacks 14*a* to 14*n* can be made up of stacks of cuts 13*a* of different stack widths as long as the row depth 13*b* is uniform. For further processing, one side of ream 13 engages alignment plate 15 (see FIG. 6) while its opposite side, which faces control panel 21, can extend to varying distances between rows of stacks.

Whereas the present invention has been described with respect to specific embodiments thereof, it will be understood that various changes and modifications will be suggested to one of ordinary skill in the art, and it is intended that the invention encompass such changes and modifications as fall within the scope of the apended claims.

What is claimed is:

1. Apparatus for multiply bundling a plurality of rows of stacks (14*a* to 14*n*) of cuts (13*a*), comprising:

an alignment table (11), for receiving the cuts, the alignment table (11) having a platen (11*a*);

an upstream feed pusher unit (12), located on the alignment table (11);

a move-away unit (18) located on the alignment table (11) and comprising a slotted platen (18*a*) having longitudinal slots (20);

a bundling apparatus (28), located on the alignment table (11), comprising a plurality of band stock wrapping devices placed side by side; wherein, the feed pusher unit (12) moves the stack of cuts (13*a*) towards the bundling apparatus; wherein the feed pusher unit (12), move-away unit (18) and bundling station (28) are arranged sequentially along a uniform working direction (32); and wherein the feed pusher unit (12) comprises a feed pusher moveable across the platen (11*a*) along the working direction (32).

2. The apparatus of claim 1 comprising:

individualizing means (19), the individualizing means (19) to be longitudinally movable in longitudinal slots (20) along the working direction (32), such that the individualizing means (19) are adapted to be raised and lowered relative to the slotted platen (18*a*).

3. The apparatus of claim 2 wherein the individualizing means (19) have a coefficient of friction higher than that of the slotted platen (18*a*).

4. The apparatus of claim 1 wherein the move-away unit (18) further is provided with a secondary pusher (22), said secondary pusher (22) contains pusher tabs (23), and a plane (33) extending along the surface of the slotted platen (18*a*), wherein the secondary pusher is adapted to be rotated by about 90° from the plane (33) of the slotted platen (18*a*).

5. The apparatus of claim 4 wherein the secondary pusher (22) has pusher tabs (23) extending into the longitudinal slots (20) of the slotted platen (18*a*).

6. The apparatus of claim 5 further comprising lateral guide rails (34*a*) located on either side of the slotted platen (18*a*), and wherein the secondary pusher (22) has lateral guide rollers (25) that move along the lateral guide rails (34*a*).

7. The apparatus of claim 6 further comprising:

supporting surfaces (34) connected to the lateral guide rails (34*a*), the supporting surfaces (34) to be sloped upwardly along the length of the slotted platen to the bundling station (28), and wherein the secondary pusher (22) is adapted to be raised by the supporting surfaces (34) so that the pusher tabs (23) can extend above the plane (33) of the slotted platen (18*a*).

8. The apparatus of claim 7 wherein the secondary pusher (22) is adapted to be moved by a pusher pivoting mechanism (24) over and behind a new row of stacks (14*a* to 14*n*).

9. The apparatus of claim 1 wherein the platen (11*a*) of the alignment table (11) comprises a plate (29) that extends transversely across the platen (11*a*) at a 90° angle with the working direction (32), wherein the top of said plate (29) resides flush with said platen (11*a*).

10. The apparatus of claim 9 wherein the plate (29) is adapted to be lowered into a slot (30) in the platen (11*a*) that extends transversely across the platen (11*a*) at a 90° angle with the working direction (32).

11. The apparatus of claim 9 wherein the plate (29) is adapted to be raised from a slot (30) in the platen (11*a*) that extends transversely across the platen (11*a*) at a 90° angle with the working direction (32).

12. The apparatus of claim 9 wherein the plate (29) is adapted to be raised from the platen (11*a*) thereby forming a stop (31) for the next-following rows of stacks (14*a* to 14*n*) of cuts (13) to be individualized and bundled.

13. The apparatus of claim 1 comprising scanning means (26) located between the feed pusher nit (12) and the move-away unit (18) near the platen (11*a*) for scanning the rows of stacks (14*a*–14*n*).

* * * * *